US009962803B2

(12) United States Patent
Suzue et al.

(10) Patent No.: US 9,962,803 B2
(45) Date of Patent: May 8, 2018

(54) LENS EDGING SYSTEM, EDGING SIZE MANAGEMENT DEVICE, EDGING SIZE MANAGEMENT METHOD AND METHOD OF MANUFACTURING SPECTACLE LENS

(71) Applicant: HOYA CORPORATION, Tokyo (JP)

(72) Inventors: Takahiro Suzue, Tokyo (JP); Tsukasa Sato, Tokyo (JP)

(73) Assignee: HOYA CORPORATION, Tokyo (JP)

( * ) Notice: Subject to any disclaimer, the term of this patent is extended or adjusted under 35 U.S.C. 154(b) by 67 days.

(21) Appl. No.: 14/443,482

(22) PCT Filed: Nov. 1, 2013

(86) PCT No.: PCT/JP2013/079669
§ 371 (c)(1),
(2) Date: May 18, 2015

(87) PCT Pub. No.: WO2014/080738
PCT Pub. Date: May 30, 2014

(65) Prior Publication Data

US 2015/0298278 A1 Oct. 22, 2015

(30) Foreign Application Priority Data

Nov. 26, 2012 (JP) ..... 2012-257125

(51) Int. Cl.
*B24B 9/14* (2006.01)
*B24B 49/02* (2006.01)

(52) U.S. Cl.
CPC ..... *B24B 9/148* (2013.01); *B24B 49/02* (2013.01)

(58) Field of Classification Search
CPC ..... B24B 49/02; B24B 9/148
See application file for complete search history.

(56) References Cited

U.S. PATENT DOCUMENTS 5,347,762 A 9/1994 Shibata et al.
6,813,536 B1 * 11/2004 Gottschald ..... B24B 9/148 451/42

(Continued)

FOREIGN PATENT DOCUMENTS

EP 1681136 A1 7/2006
JP H09-168954 A 6/1997

(Continued)

OTHER PUBLICATIONS

May 26, 2015 International Preliminary Report on Patentability issued in International Application No. PCT/JP2013/079669.

(Continued)

*Primary Examiner* — Marc Carlson
(74) *Attorney, Agent, or Firm* — Oliff PLC

(57) ABSTRACT

A lens edging system includes: an edger configured to perform edging to a spectacle lens in accordance with three-dimensional edging locus data obtained from edging shape data by calculation; a three-dimensional circumferential length measurement device configured to measure a circumferential length of the spectacle lens edged by the edger; and an edging size management device configured to correct a calculation parameter used for calculating the edging locus data, based on a difference between a measured circumferential length obtained by a three-dimensional circumferential length measurement device, and a theoretical circumferential length obtained by calculation.

6 Claims, 12 Drawing Sheets

(56) References Cited

U.S. PATENT DOCUMENTS

| | | | | |
|---|---|---|---|---|
| 7,448,938 | B2 * | 11/2008 | Inoguchi | B24B 49/02 451/43 |
| 8,295,961 | B2 * | 10/2012 | Daimaru | G02C 13/003 33/554 |
| 9,205,526 | B2 * | 12/2015 | Samukawa | G05B 19/19 |
| 2006/0189255 | A1 * | 8/2006 | Akiyama | B24B 9/148 451/5 |
| 2006/0276106 | A1 | 12/2006 | Inoguchi | |
| 2009/0222122 | A1 * | 9/2009 | Daimaru | G06Q 30/0603 700/98 |

FOREIGN PATENT DOCUMENTS

| | | | |
|---|---|---|---|
| JP | 3011526 | B2 | 2/2000 |
| JP | 2007-301695 | A | 11/2007 |
| JP | 4888947 | B2 | 2/2012 |
| WO | 2005/044513 | A1 | 5/2005 |

OTHER PUBLICATIONS

Nov. 26, 2013 International Search Report issued in International Patent Application No. PCT/JP2013/079669.
Jun. 16, 2016 Extended Search Report issued in European Patent Application No. 13856984.3.

* cited by examiner

S3 TRANSMISSION OF ORDERING DATA
S4 RECEPTION AS ORDER RECEPTION DATA
S5 CREATION OF JOB IDENTIFICATION INFORMATION

S22 THEORITICAL CIRCUMFERENTIAL LENGTH IS CALCULATED
S24 THEORITICAL CIRCUMFERENTIAL LENGTH IS TRANSMITTED
S26 THEORITICAL CIRCUMFERENTIAL LENGTH IS REGISTERED
S29 EDGING LOCUS DATA IS CALCULATED

S28 CALCULATION PARAMETER IS CORRECTED
S32 CIRCUMFERENTIAL LENGTH IS MEASURED

S37 WHETHER THE CIRCUMFERENTIAL DIFFERENCE IS IN PROPER RANGE IS JUDGED
S40 REQEUST FOR PROVIDING EDGING HISTORY DATA
S42 EDGING HISTORY DATA IS EXTRACTED
S43 EDGING HISTORY DATA IS TRANSMITTED
S45 AVERAGE VALUE OF CIRCUMFERENTIAL DIFFERENCE IS OBTAINED
S46 CHANGE OF CORRECTION VALUE IS REQUIRED?

| TYPE OF EDGING TOOL | MATERIAL OF SPECTACLE LENS | | | | |
|---|---|---|---|---|---|
| | M1 | M2 | M3 | M4 | M5 |
| T1 | H11 | H12 | H13 | H14 | H15 |
| T2 | H21 | H22 | H23 | H24 | H25 |
| T3 | H31 | H32 | H33 | H34 | H35 |
| T4 | H41 | H42 | H43 | H44 | H45 |
| T5 | H51 | H52 | H53 | H54 | H55 |
| T6 | H61 | H62 | H63 | H64 | H65 |

FIG. 6

EDGING HISTORY TABLE

| | JOB ID | LENS MATERIAL | EDGING TOOL | THEORITICAL CIRCUMFERENTIAL LENGTH | MEASURED CIRCUMFERENTIAL LENGTH |
|---|---|---|---|---|---|
| | ⋮ | ⋮ | ⋮ | ⋮ | ⋮ |
| ☆ | 0123 | M1 | T3 | Lr0123 | Lm0123 |
| | 0127 | M1 | T2 | Lr0127 | Lm0127 |
| | 0131 | M4 | T1 | Lr0131 | Lm0131 |
| ☆ | 0135 | M1 | T3 | Lr0135 | Lm0135 |
| | ⋮ | ⋮ | ⋮ | ⋮ | ⋮ |
| | 0156 | M2 | T1 | Lr0156 | Lm0156 |
| | 0159 | M4 | T2 | Lr0159 | Lm0159 |
| | 0165 | M1 | T1 | Lr0165 | Lm0165 |
| | 0168 | M3 | T1 | Lr0168 | Lm0168 |
| ☆ | 0174 | M1 | T3 | Lr0174 | Lm0174 |
| | ⋮ | ⋮ | ⋮ | ⋮ | ⋮ |
| ☆ | 0191 | M1 | T3 | Lr0291 | Lm0291 |
| | 0199 | M1 | T2 | Lr0299 | Lm0299 |
| | 0203 | M4 | T1 | Lr0203 | Lm0203 |
| | 0209 | M3 | T2 | Lr0209 | Lm0209 |
| ☆ | 0212 | M1 | T3 | Lr0212 | Lm0212 |
| | ⋮ | ⋮ | ⋮ | ⋮ | ⋮ |

(OLD)

(REGISTRATION IN TIME SERIES)

(NEW)

LENS EDGING SYSTEM, EDGING SIZE MANAGEMENT DEVICE, EDGING SIZE MANAGEMENT METHOD AND METHOD OF MANUFACTURING SPECTACLE LENS

TECHNICAL FIELD

The present invention relates to a lens edging system used for edging a spectacle lens, an edging size management device, an edging size management method and a method of manufacturing a spectacle lens.

DESCRIPTION OF RELATED ART

Generally, edging is performed to a spectacle lens, so that a spectacle lens (uncut lens) whose outer shape is not edged, is framed into a spectacle frame. In edging the spectacle lens, the spectacle lens is edged so as to suit to the shape of the spectacle frame (frame shape of a portion into which the spectacle lens is fitted). As such an ordering system of a spectacle lens including edging, there is known a system of transmitting information required for edging the spectacle lens to an edging center at a reception side, from a spectacle shop at an order side, and supplying the spectacle lens edged in the edging center using the information, to the spectacle shop.

An edger is used for edging the spectacle lens. A size of the spectacle lens edged by this edger is sometimes deviated from a desired range in the case of the spectacle lens edged at a different timing from the timing when edging applied thereto due to deterioration of an edging performance such as a wear or clogging of an edging tool, even if the size is set in a desired range without problem for framing the lens into the spectacle frame. In this case, adjustment of an edging size (called size adjustment hereafter) is required for setting the edging size of the spectacle lens in a desired range.

As an example of the size adjustment, for example patent document 1 teaches a technique of adjusting an axis distance between a lens axis which is a rotation axis of a lens holder and a holding axis of the edging tool, in accordance with a difference of a circumferential length of the lens (called a lens circumferential difference hereafter (difference between an actual circumferential length and a theoretical circumferential length)) in edging, when the circumferential length of the spectacle lens after edging is managed (see claim 1 and paragraph 0018 of patent document 1).

PRIOR ART DOCUMENT

Patent Document

Patent document 1: Patent Publication No. 4888947

SUMMARY OF THE INVENTION

Problem to be Solved by the Invention

However, in a technique of adjusting the axis distance, collapse of an outer shape of the spectacle lens after edging occurs, although the lens circumferential difference can be set to be small (detailed explanation is given later). Therefore, improvement of further edging precision is desired for providing a high quality spectacle. Further, adjustment of the axis distance is performed per each unit of the edging tool, and therefore if the axis distance is adjusted for a certain edging tool, similar size correction is added to all spectacle lenses to be edged by this edging tool thereafter. Accordingly, in the adjustment of the axis distance, the edging size can be corrected only in the unit of the edging tool (called the edging tool unit hereafter), thus involving a problem that the adjustment cannot respond to the size of each material of the spectacle lens.

Therefore, an object of the present invention is to provide a technique of adjusting the edging size of the spectacle lens, without collapsing the outer shape of the spectacle lens.

Means for Solving the Problem

According to a first aspect of the present invention, there is provided an edging system, including:

an edger configured to perform edging to a spectacle lens in accordance with three-dimensional edging locus data obtained from edging shape data by calculation;

a three-dimensional measurement device configured to three-dimensionally measure an edging size of the spectacle lens edged by the edger; and an edging size management device configured to correct a calculation parameter used for calculating the edging locus data based on a difference between a measured value of the edging size obtained by measurement by the three-dimensional measurement device, and a theoretical value of the edging size obtained by calculation.

According to a second aspect of the present invention, there is provided the lens edging system of the first aspect, wherein the edging size management device stores and holds a correction value in association with a material of the spectacle lens and a type of an edging tool, and correct the calculation parameter for each material of the spectacle lens and for each type of the edging tool, using the stored and held correction value.

According to a third aspect of the present invention, there is provided the lens edging system of the first aspect or the second aspect, including:

an edging history memory part configured to sequentially store the measured value of the edging size and the theoretical value of the edging size as edging history data, in association with the material of the spectacle lens and the type of the edging tool used for this edging, every time the edging is performed once;

an extraction part configured to extract a plurality of edging history data stored in the edging history memory part in the same combination as the combination of the material of the spectacle lens and the type of the edging tool used for this edging; and a change part configured to obtain an average value of the difference between the measured value of the edging size and the theoretical value of the edging size using the plurality of edging history data extracted by the extraction part, and when the obtained average value exceeds a preset defined range, change the correction value used in the same combination as the combination of the material of the spectacle lens and the type of the edging tool used for this edging.

According to a fourth aspect of the present invention, there is provided an edging size management device, used in connection with an edger that performs edging to a spectacle lens in accordance with three-dimensional edging locus data obtained from edging shape data by calculation, comprising:

a calculation part configured to calculate a difference between a measured value of an edging size obtained by three-dimensionally measuring an edging size of the spectacle lens edged by the edger, and a theoretical value of the edging size obtained by calculation; and a correction part configured to correct a calculation parameter used for calculating the edging locus data, based on the calculated difference.

According to a fifth aspect of the present invention, there is provided an edging size management method, for managing an edging size of a spectacle lens edged by an edger that performs edging to a spectacle lens in accordance with three-dimensional edging locus data obtained from edging shape data by calculation, comprising:

calculating a difference between a measured value of an edging size obtained by three-dimensionally measuring the edging size of the spectacle lens edged by the edger, and a theoretical value of the edging size obtained by calculation; and correcting a calculation parameter used for calculating the edging locus data, based on the calculated difference.

According to a sixth aspect of the present invention, there is provided a method of manufacturing a spectacle lens, including:

calculating the edging locus data using the calculation parameter corrected by the edging size management method of claim 5; and edging a spectacle lens by the edger in accordance with the edging locus data obtained by the calculation.

Effect of the Invention

According to the present invention, an edging size of a spectacle lens can be adjusted without collapsing an outer shape of the spectacle lens.

BRIEF DESCRIPTION OF THE DRAWINGS

FIG. 6 is a view showing a registration content of edging history data in an edging history table.

DETAILED DESCRIPTION OF THE INVENTION

Embodiments of the present invention will be described hereafter in detail, with reference to the drawings.

Figure 1:
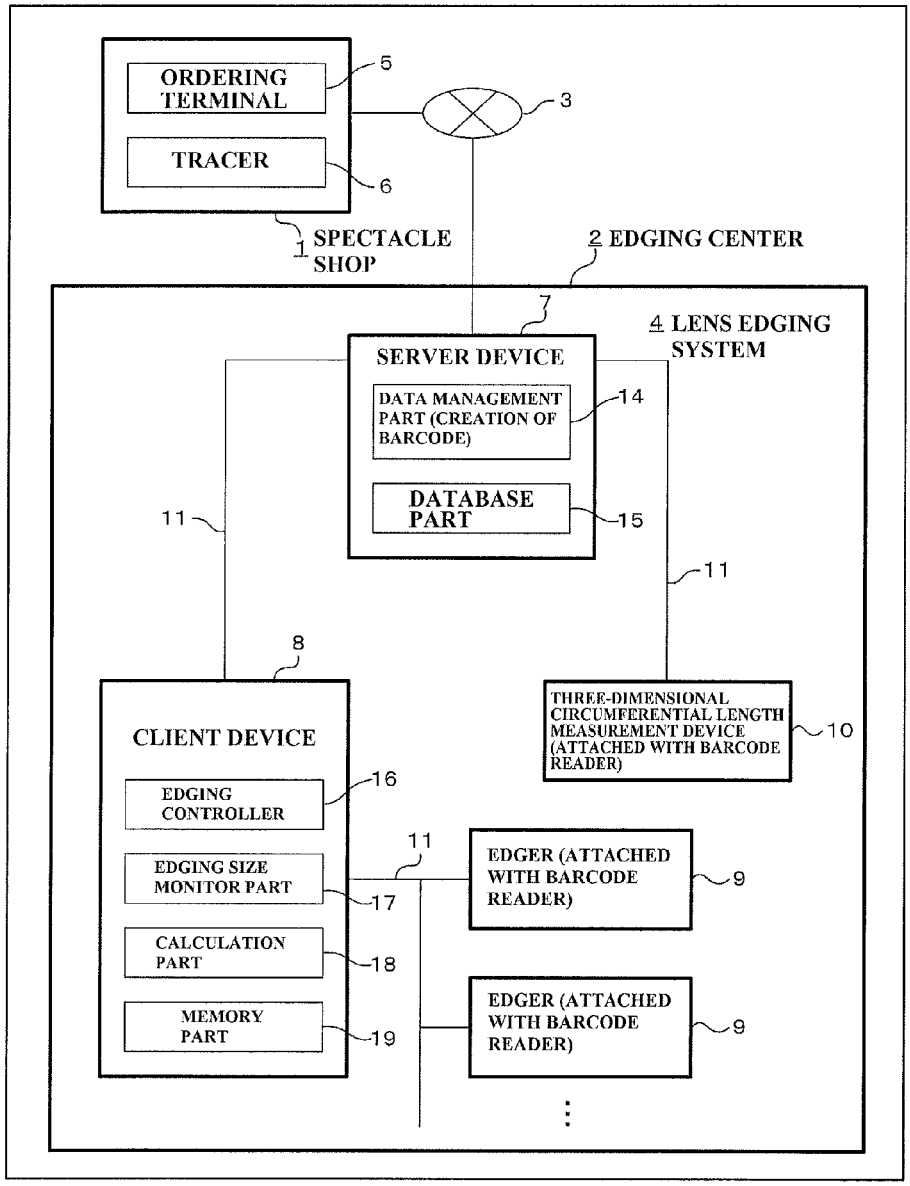
FIG. 1 is a block diagram showing a constitutional example of an ordering system of a spectacle lens according to the present invention.

FIG. 1 is a block diagram showing a constitutional example of an ordering system of a spectacle lens according to the present invention. In the ordering system, a terminal of a spectacle shop 1 at an order side, and a terminal of an edging center 2 at a reception side, are connected to each other that can be communicated via a communication line 3. The communication line 3 may be a public communication line or may be a dedicated communication line. A lens edging system 4 is constructed in the edging center 2. The number of devices (including equipment and terminals) constituting the lens edging system 4 is not limited to one, and a plurality of devices may be used for constituting the lens edging system 4. Further, the order side is not limited to the spectacle shop 1, and for example, when an external edging plant and other lens maker entrust edging of the spectacle lens, to the edging center 2, the edging plant and the lens maker are the order side.

An ordering terminal 5 and a tracer 6 are installed in the spectacle shop 1. A server device 7, a client device 8, an edger 9, and a three-dimensional circumferential length measurement device 10 are installed in the edging center 2, and a lens edging system 4 is constituted of these devices. Further, a plurality of (only two in the figure) edgers 9 are connected to one client device 8 respectively. Edger identification information specific to each of the edger 9 is assigned to a plurality of edgers 9. The devices installed in the edging center 2 are connected so as to be communicated with each other via a network 11 of the edging center 2.

(Ordering Terminal)

An ordering terminal 5 is configured using a computer device. The computer device includes a calculation function, a control function, a storage function, and an input/output function, etc. Specifically, the computer device is configured using a hardware resource such as CPU (Central Processing Unit), ROM (Read-Only Memory), RAM (Random Access Memory), and HDD (Hard disk drive), etc.

The ordering terminal 5 is connected to the communication line 3 via a router, etc., not shown, and is configured to transfer data to/from the external terminal (a server device 7 of the edging center 2 in this embodiment) through the communication line 3. The ordering terminal 5 receives input of ordering data required for requesting the edging center 2 to edge a spectacle lens (ordering), and transmits the received ordering data to the server device 7 of the edging center 2. An operation of the ordering terminal 5 is performed by a clerk of the spectacle shop 1.

(Tracer)

The tracer 6 is configured to three-dimensionally measure a frame shape of the spectacle frame. Frame shape data of the spectacle frame obtained by measurement by the tracer 6, is the data for specifying the frame shape of the spectacle frame in a three-dimensional coordinate space. The tracer 6 has a contactor for measuring a shape, and a support shaft for supporting the contactor. The tracer 6 measures the frame shape of the spectacle frame in such a manner that the contactor is brought into contact with a groove of a rim portion (portion into which the spectacle frame is framed) of the spectacle frame to be measured. An object to be measured by the tracer 6 includes not only the spectacle frame, but also an original lens (dummy lens and pattern) fitted into the spectacle frame as a "rimless spectacle" for example. In any case, the frame shape data obtained by measurement by the tracer 6 is three-dimensional data for specifying the frame shape of the spectacle frame. A publicly-known tracer 6 (for example, tracer disclosed in Japanese Patent Laid Open Publication No. 2009-243952, and International Publication No. 2007/077848) can be used.

(Server Device)

The server device 7 is configured using the computer device, and includes a data management part 14 and a database part 15. The data management part 14 manages each kind of data using the database part 15. For example, the data management part 14 receives ordering data transmitted from the ordering terminal 5 of the spectacle shop 1 via the communication line 3, and registers the order reception data in the database part 15 as order reception data. Further, when the order reception data is registered in the database part 15, the data management part 14 creates job identification information regarding the job for edging the spectacle lens, every time the order reception data is received, and registers the order reception data in the database part 15 in association with the job identification information. Therefore, single job identification information is created for every single edging performed to the spectacle lens. Further, a relation between the job identification information registered in the database part 15 and the order reception data, is a one-to-one relation.

The data management part 14 converts the job identification information created as described above, to a two-dimensional barcode for example, and print-outs a work sheet with barcode by transmitting the barcode to a printer not shown. The work sheet is a sheet-like paper medium for example. The work sheet is put in a tray not shown, together with the spectacle lens (uncut lens) before edging which is specified by the order reception data.

The spectacle lens is configured for a left eye and a right eye, and subjected to edging or other treatment individually. However, treatment contents of them are common in the left eye and the right eye. Therefore, in the paragraphs thereafter, the treatment contents will be described in the following paragraphs without distinction for the left eye and for the right eye, and as a common item.

The database part 15 is configured to store and hold various information (data) required for operating the ordering system (including the lens edging system 4) of the spectacle lens. For example, design data and edging history data, etc., of the spectacle lens are stored in the database part 15, other than the abovementioned order reception data. The design data of the spectacle lens is the data for three-dimensionally specifying surface shapes of two optical surfaces of the spectacle lens. The edging history data will be described later.

(Client Device)

The client device 8 constitutes an edging size management device together with the server device 7. The client device 8 is constituted using a computer device, and includes an edging controller 16, an edging size monitor part 17, a calculation part 18, and a memory part 19. In FIG. 1, the server device 7 and the client device 8 are shown as an independent constitutional elements respectively. However, the present invention is not limited thereto, and the server device 7 and the client device 8 can be realized by one computer. Further, when a plurality of client devices 8 are installed in the edging center 2, a structure of connecting the plurality of client devices 8 to a common server device 7 via a network 11, can also be employed.

When edging is performed to the spectacle lens using each edger connected to the client device 8, the edging controller 16 performs various control processing. The edging size monitor part 17 is configured to monitor the size of the spectacle lens edged by the edger 9, and perform processing for a size adjustment as needed.

The calculation part 18 is configured to perform each kind of calculation processing regarding edging of the spectacle lens. Calculation items performed by the calculation part 18 include at least edging shape data, and differential data of the edging size, etc. Each edger 9 calculates three-dimensional edging locus data using the edging shape data, and performs edging to the spectacle lens in accordance with the edging locus data.

The edging shape data is the data calculated using frame shape data, etc., of the spectacle frame, and is the data showing a three-dimensional shape (solid shape) of the spectacle lens after edging. The edging size is the size of the spectacle lens in an edged state. In this embodiment, as an example, the circumferential length of the spectacle lens in the edged state, is the edging size.

The differential data of the edging size is the data showing a difference between a measured value of the edging size obtained by measurement by a three-dimensional measurement device, and a theoretical value of the edging size obtained by calculation. In this embodiment, a three-dimensional circumferential length measurement device 10 is used as the three-dimensional measurement device. Therefore, the differential data of the edging size is the data showing the difference between a measured circumferential length obtained by measurement by the three-dimensional circumferential length measurement device, and a theoretical circumferential length obtained by calculation.

The edging locus data is obtained by calculating a moving amount of each drive shaft at each cutting point using the edging shape data, as the data for determining an edging condition for edging the spectacle lens to be edged in accordance with the frame shape of the spectacle frame. The edging condition includes a drive condition for a cutting pressure or a grinding pressure, a cutting amount of the edging tool, the number of rotations of the tool, and a rotation speed of a lens axis, when performing edging to the spectacle lens by the edger 9, and specifically indicates the following condition: namely, which order is employed to select a plurality of edging tools of the edger 9, and how to drive a holding axis or a lens axis of the selected edging tool or other actuator to edge the spectacle lens.

The memory part 19 is configured to store information other than the information stored in the database part 15, out of the information regarding the edging of the spectacle lens. The information stored in the memory part 19 includes a calculation parameter used for calculating the edging locus data, and a correction table in which a correction value used for correcting the calculation parameter is stored (described later in detail). Although there are a plurality of calculation parameters used for calculating the edging locus data, the calculation parameter to be corrected, is the parameter capable of changing the edging size of the spectacle lens. Therefore, when the value of the calculation parameter is changed (corrected), the edging locus data calculated using the calculation parameter before change, and the edging locus data calculated using the calculation parameter after change, are different from each other. As a result, the size (edging size) of the spectacle lens obtained by edging, is also different.

In this embodiment, the following case is estimated as an example: the size of the spectacle lens that can be adjusted by correcting the calculation parameter is the circumferential length of the spectacle lens. Also, the tool diameter value of the edging tool of the edger 9 is estimated as the calculation parameter capable of adjusting the circumferential length of the spectacle lens. The tool diameter of the edging tool corresponds to a radius of a grinding wheel when the spectacle lens is edged by a cylindrical grinding wheel for example.

(Edger)

The edger 9 performs edging to the spectacle lens. Edging of the spectacle lens means as follows: the spectacle lens called an uncut lens, is edged in accordance with the frame shape of the spectacle frame into which the spectacle lens is framed. The edging of the spectacle lens by the edger 9 is performed through two edging steps such as rough edging and finish edging. The rough edging is the edging step of edging the spectacle lens into a shape slightly larger than a final finish shape. The finish edging is the edging step including bevel edging, for edging the spectacle lens after rough edging, in accordance with a final finish shape of the spectacle lens.

The rough edging and the finish edging may be performed in each step, with the edging tool changed, or may be performed using the same edging tool. Further, an edging system of the rough edging and the finish edging may be changed in each step, like cutting for the rough edging, and grinding for the finish edging, or the same edging system may be used. Further, mirror-finish may also be included in the finish edging as needed. The mirror finish is the processing of giving a polish to an edge surface of a lens by a tool with a fine texture.

The bevel edging is the edging of forming a bevel on an outer circumferential surface of the spectacle lens. There are a plurality of types (shapes) in the bevel of the spectacle lens. As an example of the bevel type, there are a mountain-like bevel, a groove-like bevel, and a flat bevel, etc. The type of the edging tool used for the finish edging, is different in each bevel type.

A barcode reader is attached to the edger 9. The barcode reader is configured to optically read a barcode printed on the work sheet, and acquire job identification information shown by the barcode. The edger 9 receives the information required for edging the spectacle lens, from the client device 8, by transmitting to the client device 8 the job identification information obtained as a result of reading the barcode reader.

(Three-Dimensional Circumferential Length Measurement Device)

The three-dimensional circumferential length measurement device 10 is provided as an example of an edging size measurement device for three-dimensionally measuring the edging size of the spectacle lens edged by the edger 9. The three-dimensional circumferential length measurement device 10 is configured to three-dimensionally measure the circumferential length of the spectacle lens which is already subjected to edging (finish edging) by the edger 9. The three-dimensional circumferential length measurement device 10 has a stylus, which is a measuring element, for measuring a circumferential length. When the bevel type of the spectacle lens to be measured is the mountain-like bevel, the three-dimensional circumferential length measurement device 10 measures the circumferential length of the spectacle lens by making the stylus in contact with a top of the bevel formed on the edge surface, and rotating the spectacle lens while maintaining this contact state. Also, when the bevel type is the flat bevel (plano bevel), or the bevel having a groove on the edge surface, the three-dimensional circumferential length measurement device 10 measures the circumferential length of the spectacle lens by making the stylus in contact with the edge surface forming the flat bevel, and rotating the spectacle lens while maintaining this contact state. In this case, the three-dimensional circumferential measurement device 10 recognizes a displacement amount and a displacement direction of the stylus caused by the rotation of the spectacle lens in a three-dimensional coordinate space, and based on this recognition result, measures the circumferential length of the bevel top of the spectacle lens. Data of the measured circumferential length of the spectacle lens obtained by the measurement by the three-dimensional circumferential length measurement device 10 is sent to the server device via the network 11. As the three-dimensional circumferential length measurement device 10, for example, the device described in Patent Publication No. 3208566 can be used.

The barcode reader is attached to the three-dimensional circumferential length measurement device 10. The barcode reader is configured to optically read the barcode printed on the worksheet and acquire the job identification information shown by the barcode. The three-dimensional circumferential length measurement device 10 transmits to the server device 7 the job identification information obtained as a result of reading by the barcode reader, together with the data of the measured circumferential length of the spectacle lens corresponding to the job identification information.

(Flow of the Process Regarding Ordering of the Spectacle Lens)

Figure 2:
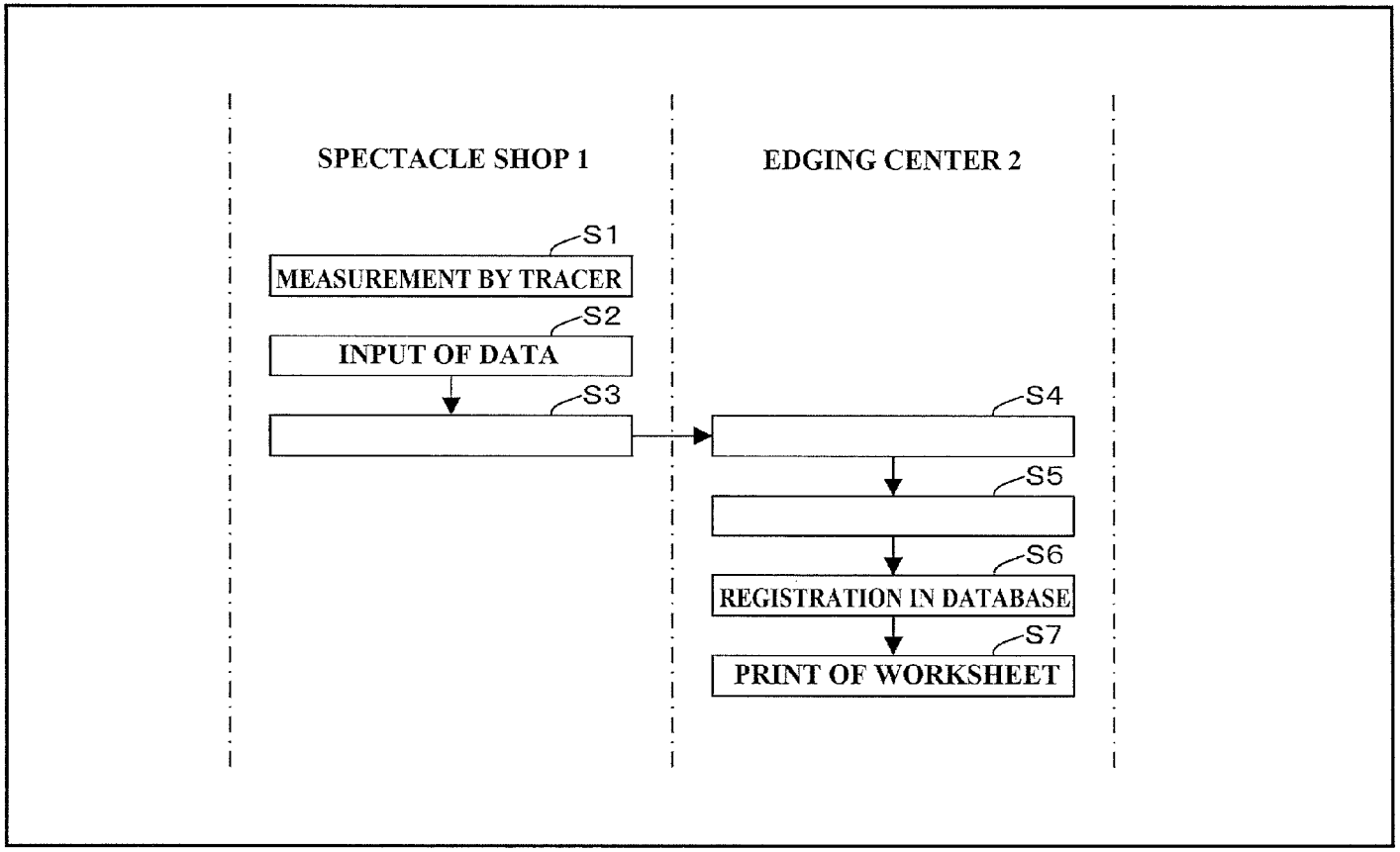
FIG. 2 is a flowchart showing a flow of a process regarding ordering of the spectacle lens.

FIG. 2 is a flowchart showing a flow of the process regarding ordering of the spectacle lens.

First, in spectacle shop 1, the spectacle frame desired (selected) by a client is set in a tracer 6, so that the frame shape of the spectacle frame is measured (S1). The data obtained by measuring by the tracer 6, is captured by the ordering terminal 5. Next, a clerk of the spectacle shop 1 inputs the ordering data using the ordering terminal 5 (S2). The ordering data includes spectacle frame information, spectacle lens information, layout information, and prescription information, etc. The spectacle frame information includes a frame maker, a model name, a frame material, a frame size, a frame pattern, and a frame color, etc., other than the abovementioned frame shape data of the spectacle frame. The spectacle lens information includes a lens material, presence/absence of a functional film (dimming/polarization), a lens color, presence/absence of a hard coat film, and a product code, etc. The layout information includes a pupil distance and pupil height, etc. The prescription information includes a spherical power, astigmatic power, astigmatic axis, addition power, and prism prescription, etc. Next, the ordering data is sent to the server device 7 of the edging center 2 from the ordering terminal 5 via the communication line 3 (S3). The ordering data is sent by the clerk who performs input operation while observing a screen for ordering displayed on a monitor of the ordering terminal 5, when ordering is confirmed by mouse click operation after end of the input of the ordering data.

On the other hand, in the edging center 2, the ordering data sent from the ordering terminal 5 of the spectacle shop 1, is received by the server device 7 as order reception data (S4). Next, the data management part 14 of the server device 7 creates the job identification information at a suitable timing after receiving the order reception data (S5). Next, the data management part 14 registers the order reception data in the database part 15, in association with the created job identification information (S6).

Next, in the edging center 2, the work sheet with barcode is printed out using a printer not shown (S7), as a preparation work before edging. As described above, the process regarding ordering is completed. Thereafter, in the edging center 2, the spectacle lens (uncut lens) indicated by the order reception data, is put in a tray by a worker, together with the work sheet with barcode, which is then transferred to a place where the edger 9 in charge of edging is installed. At this time, the spectacle lens put in the tray may be the uncut lens of a stock lens, or may be the uncut lens of a custom-made lens.

(Flow of a Process Regarding Edging of the Spectacle Lens)

Figure 3:
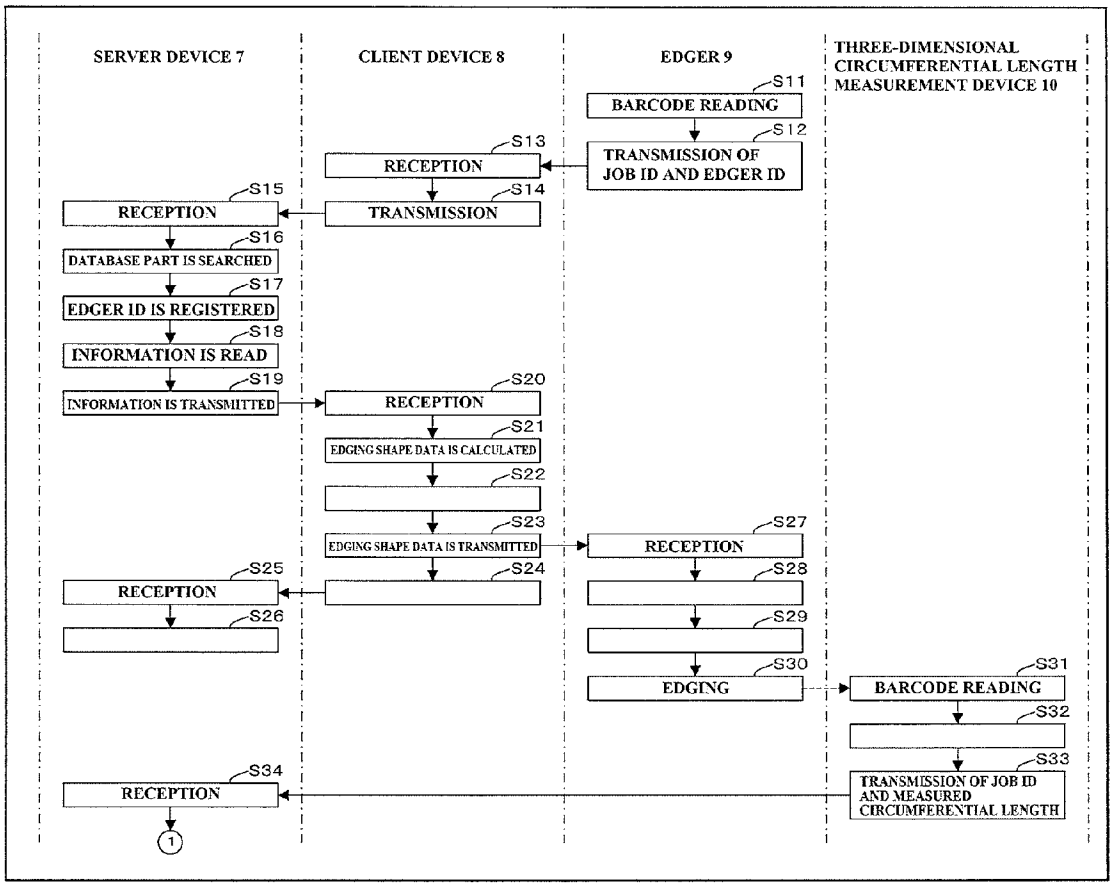
FIG. 3 is a flowchart (No. 1) showing the flow of the process regarding edging of the spectacle lens.
Figure 4:
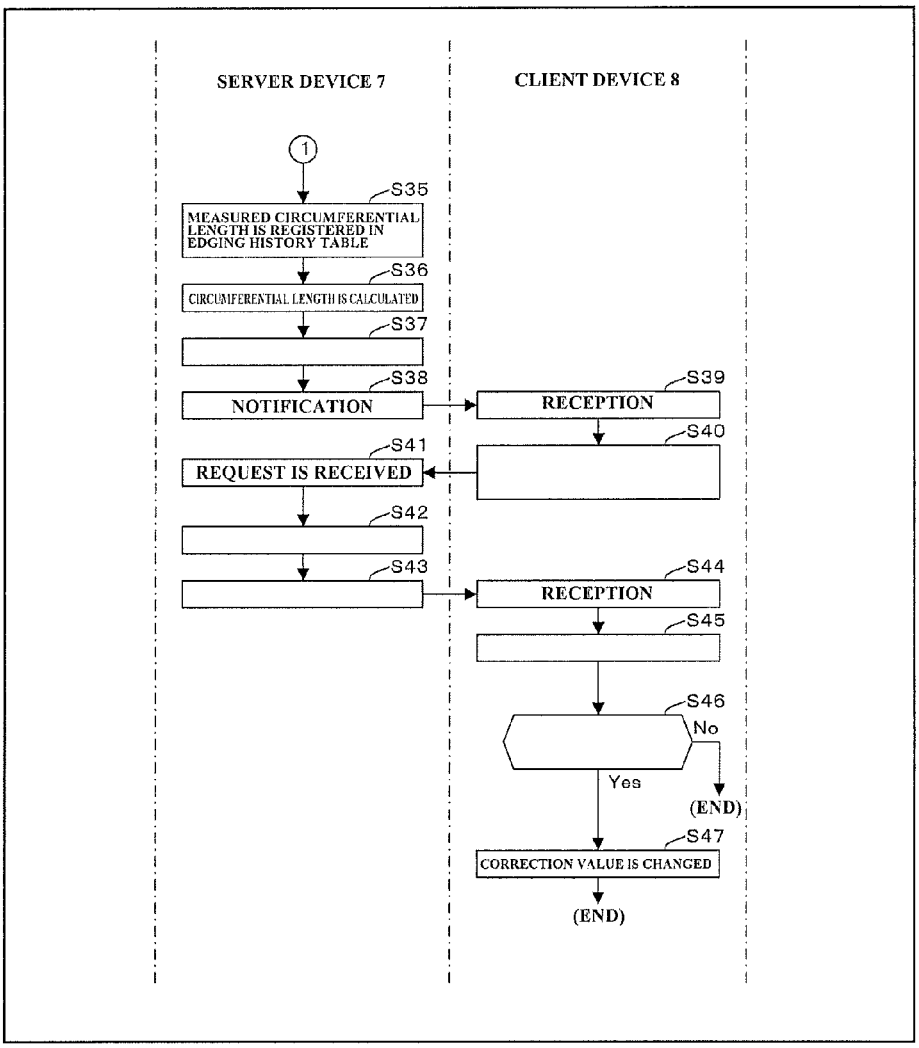
FIG. 4 is a flowchart (No. 2) showing the flow of the process regarding edging of the spectacle lens.

FIG. 3 and FIG. 4 are flowcharts showing a flow of a process regarding edging of the spectacle lens.

First, the operator of the edger 9 takes out the work sheet from the tray, and reads the barcode printed on the work sheet by the barcode reader attached to the edger 9 (S11). Then, the edger 9 transmits the job identification information obtained as a result of reading by the barcode reader, to the client device 8 via the network 11, together with the edger identification information allocated to its own device (S12).

Next, the edging controller 16 of the client device 8 receives the job identification information and the edger identification information sent from the edger 9 (S13). Next, the edging controller 16 transmits (transfers) the received job identification information and the edger identification information to the server device 7 (S14).

Next, the data management part 14 of the server device 7 receives the job identification information and the edger identification information sent from the client device 8 (S15). Next, the data management part 14 searches the database part 15 using the job identification information as a search key, out of the received job identification information and the edger identification information (S16). Next, the data management part 14 registers the received edger identification information in association with the job identification information corresponding to the search key (S17). Thus, in the database part 15, the order reception data and the edger 9 that performs edging based on the order reception data, are tied using the same job identification information. Next, the data management part 14 reads the information required for edging of the spectacle lens, from the order reception data registered in the database part 15 (S18). The information required for edging of the spectacle lens includes spectacle frame information, spectacle lens information, layout information, and prescription information, etc. Next, the data management part 14 transmits the readout information to the client device 8 (S19).

Next, the edging controller 16 of the client device 8 receives the information required for edging of the spectacle lens, transmitted from the server device as described above (S20). Next, the calculation part 18 of the client device 8 calculates the edging shape data using the information previously received by the edging controller 16 (S21). Various data is used for calculating the edging shape data. As one of the data regarding the edger 9, there is a value (design value) of a tool diameter of the edger 9 included in the data. The data regarding the edger 9 (including the type of the edging tool and the value of each tool diameter) is stored in the memory part 19 in each edger 9, by notifying the client device 8 of the data regarding its own device from the edger 9, in a stage when the edger 9 is connected to the network 11. The following configuration may also be acceptable: namely, the data regarding the edger 9 may be stored in the database part 15 of the server device 7 in each edger 9, instead of the memory part 19 of the client device 8, so that the client device 8 reads the data regarding the edger 9, from the database part 15.

Further, the calculation part 18 calculates the theoretical circumferential length of the spectacle lens, other than the abovementioned edging shape data (S22). The theoretical circumferential length is the length corresponding to a theoretical value obtained by calculation as the edging size of the spectacle lens after edging. The theoretical circumferential length is the circumferential length of the spectacle lens based on the edging shape data obtained by correcting the frame shape data, so that the lens after edging can be firmly fitted into a frame selected by a client, when edging the uncut lens in accordance with designated bevel size, bevel position, and bevel mode, etc. The theoretical circumferential length is calculated as the circumferential length of the spectacle lens which is regarded as preferable from a viewpoint of improving a fitting rate. Accordingly, when the circumferential length of the spectacle lens after edging is matched with the theoretical circumferential length, this is an ideal state. Regarding the calculation of the theoretical circumferential length, for example, a calculation method described in U.S. Pat. No. 2,994,870 may be employed. The calculation part 18 has a calculation program for edging calculation, and by executing the calculation program, the edging shape data and the theoretical circumferential length are obtained. There are various information as the information required for these calculations, other than the information described here. However, explanation is omitted here.

Next, the edging controller 16 of the client device 8 transmits to the edger 9, the edging shape data previously calculated by the calculation part 18 (S23). At this time, the edging controller 16 transmits the correction value to the edger 9, which is used for correcting the "tool diameter value of the edging tool" which is one of the calculation parameters of edging locus data, together with the edging shape data. The correction value is read from the memory part 19 by the edging controller 16.

Figure 5:
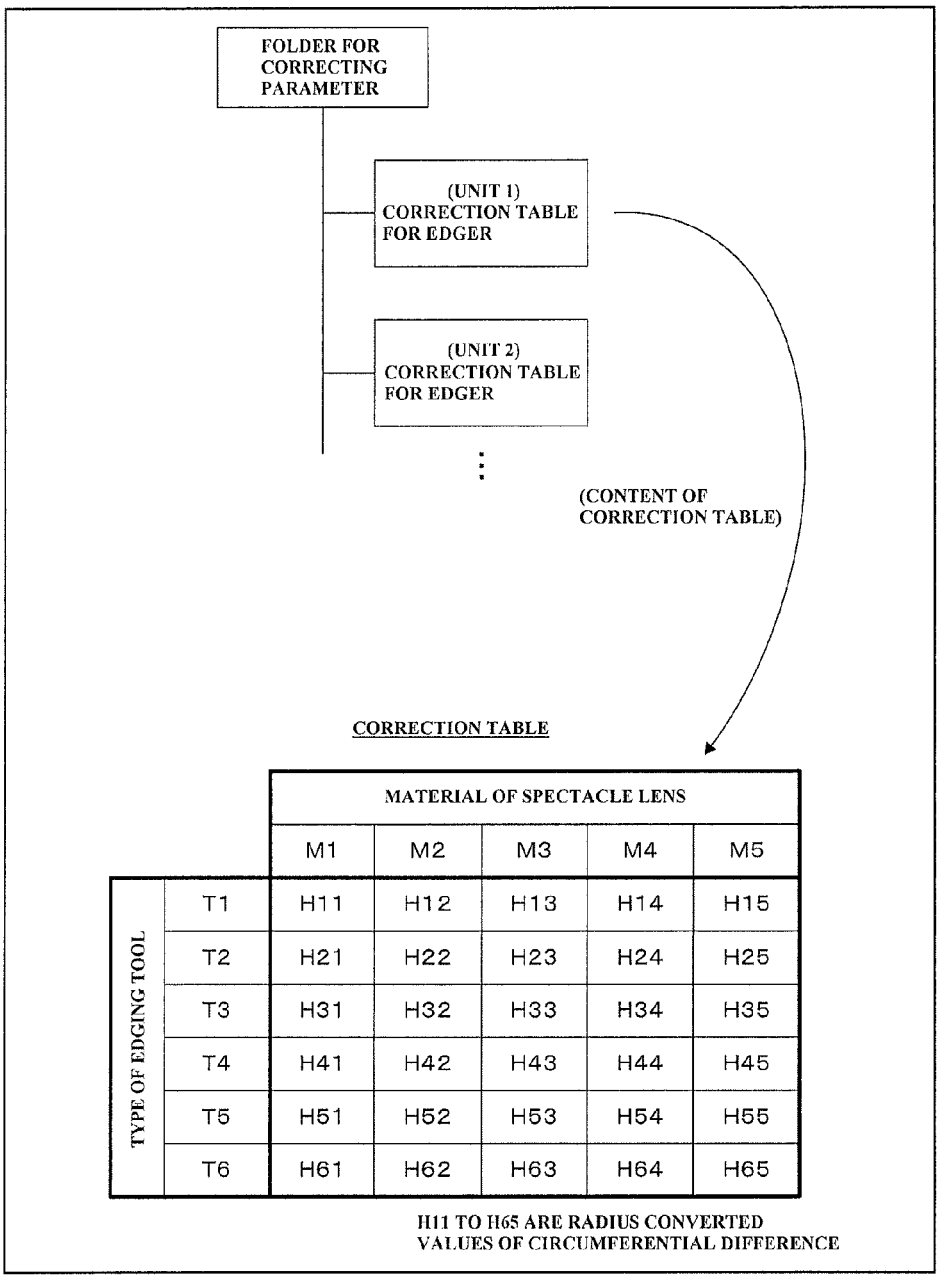
FIG. 5 is a view showing an example of a storage form of a correction value used for correcting a value of a tool diameter of an edging tool.

FIG. 5 is a view showing an example of a storage form of the correction value used for correcting the tool diameter value of the edging tool. In FIG. 5, a parameter correcting folder is the folder for storing a correction table for correcting the calculation parameter used for calculating the edging locus data. The correction table is prepared in the parameter correcting folder for each edger 9. A plurality of edgers 9 are divided into unit 1, unit 2, for the convenience.

The correction value is registered (stored) in the correction table, in association with the material of the spectacle lens and the type of the edging tool. Specifically, the material of the spectacle lens is divided into five types of M1 to M5, and the type of the edging tool is divided into six types of T1 to T6. Then, thirty correction values (H11 to H65) in total are registered according to the number of the combinations of the material of the spectacle lens and the type of the edging tool. The number of storage of the correction value can be suitably increased or decreased according to the type of the edging tool and the type of the spectacle lens.

Each correction value is the value obtained by converting the difference between the measured circumferential length and the theoretical circumferential length to a radius. Out of the edging tools of one edger 9 based on this correction table, the edging tools T1 to T6 registered in this correction table is the edging tool used for at least the finish edging (bevel edging). A different type of the edging tool is selected for the finish edging, according to the type of the bevel formed on the edge surface of the spectacle lens. Therefore, the bevel type of the spectacle lens may be registered in the correction table, instead of the type of the edging tool.

The correction value is read as follows. First, the material of the spectacle lens to be edged is specified, with reference to spectacle lens information included in the data previously received by the edging controller 16 from the server device 7. When the material of the spectacle lens is assumed to be M3, and when the edger 9 used for edging is assumed to be unit 1, and the type of the edging tool used for the finish edging is assumed to be T2, the edging controller 16 reads a correction value H23 from the correction table, which is stored in the memory part 19 corresponding to the edger 9 of the unit 1, and transmits the correction value T23 to the edger 9 together with the edging shape data.

Next, the edging controller 16 transmits the theoretical circumferential length previously calculated by the calculation part 18, to the server device 7 together with job identification information (S24). Thus, the data management part 14 of the server device 7 receives the theoretical circumferential length from the client device 8 (S25), and registers the received theoretical circumferential length in the edging history table of the database part 15 in association with the job identification information (S26).

The edging history table is stored in the database part 15 in a data form shown in FIG. 6 for example. The edging history table shown in the figure is prepared for each edger 9. The edging history data is the data regarding the theoretical circumferential length and the measured circumferential length registered in the edging history table in time series, in association with the material of the spectacle lens and the type of the edging tool. Single job identification information is created for each single edging performed to the spectacle lens. Therefore, single edging history data is stored for each single edging performed to the spectacle lens, and is sequentially accumulated by increasing the number of the edging. The type of the spectacle lens taken out from the order reception data, is registered in the column of the material of the spectacle lens. The type of the edging tool corresponding to the bevel type of the spectacle lens, is registered in the column of the edging tool. The theoretical circumferential length received from the client device 8, is registered in the column of the theoretical circumferential length. The column of the measured circumferential length is a blank space in this stage.

The edging history table is not necessarily required to be prepared by dividing it for each edger 9. Specifically, one edging history table is prepared, and the edging history data regarding all edgers 9 may be registered in this edging history table. In this case, the edging history data is registered for each job identification information, and edging device identification information may be included in the edging history data, so as to identify the edger 9 used for edging.

Next, in the edger 9, the edging shape data and the correction value for correcting the calculation parameter, are received which are transmitted from the client device 8 (S27). Next, in the edger 9, the calculation parameter used for calculating the edging locus data, is corrected using the abovementioned correction value (S28). Specifically, the tool diameter value of the edging tool used for the calculation parameter, is corrected using the correction value received together with the edging shape data. For example, when the tool diameter value used for calculating the edging locus data is tool radius Ra, when the design tool diameter value is tool radius Rb, and when the abovementioned correction value H23 can take plus or minus values, the tool radius Ra is corrected based on the following formula (1), and the edging locus data is calculated using the tool radius Ra after edging as the calculation parameter.

$$Ra=Rb+H23 \quad (1)$$

The correction value used for correcting the calculation parameter may be acquired by the edger 9 at any timing, if the correction value is acquired before the edging locus data is calculated by the calculation part 18. Further, the acquisition system of the correction value may be the system of reading and acquiring the correction value required for calculating the edging locus data, from the correction table for its own device stored in the calculation part 18.

Next, in the edger 9, the edging locus data is calculated based on the edging shape data (S29). The calculation parameter (tool diameter value) previously corrected by the correction value, is used for calculating the edging locus data. The edging locus data obtained by this calculation is three-dimensional data. Therefore, in the case of correcting the tool diameter value used for calculating the edging locus data, the tool diameter value after correction can be reflected on the three-dimensional edging locus data.

Here, explanation is given for a relation between the tool diameter value used for calculating the edging locus data, and the circumferential length of the spectacle lens edged in accordance with the edging locus data.

First, regarding the tool diameter used for calculating the edging locus data, if the tool diameter value after correction is smaller than the tool diameter value before correcting by the correction value, the circumferential length of the spectacle lens finished by edging becomes short. On the other hand, if the tool diameter value after correction is larger than the tool diameter value before correction by the correction value, the circumferential length of the spectacle lens finished by edging becomes long. The reason thereof will be described hereafter using FIG. 7 to FIG. 9.

Figure 7:
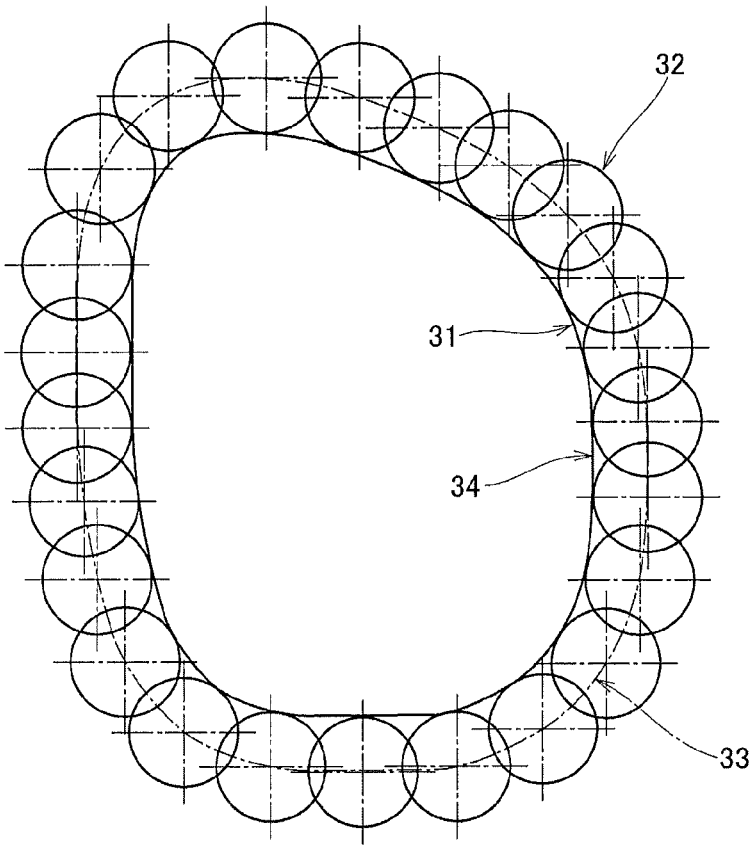
FIG. 7 is a view (No. 1) showing a relation between the tool diameter value used for calculating the edging locus data, and a circumferential length of a spectacle lens edged in accordance with the edging locus data.

FIG. 7 shows a case of not correcting the tool diameter value used for calculating the edging locus data, namely, a case that the correction value is zero. In this case, the edging locus data 33 is calculated using the tool diameter value (design value of the edging tool) 32 as it is, which is defined and used for calculating the edging shape data 31. Therefore, the outer shape 34 of the spectacle lens edged by the defined tool diameter 32, is matched with the edging shape data 31.

Figure 8:
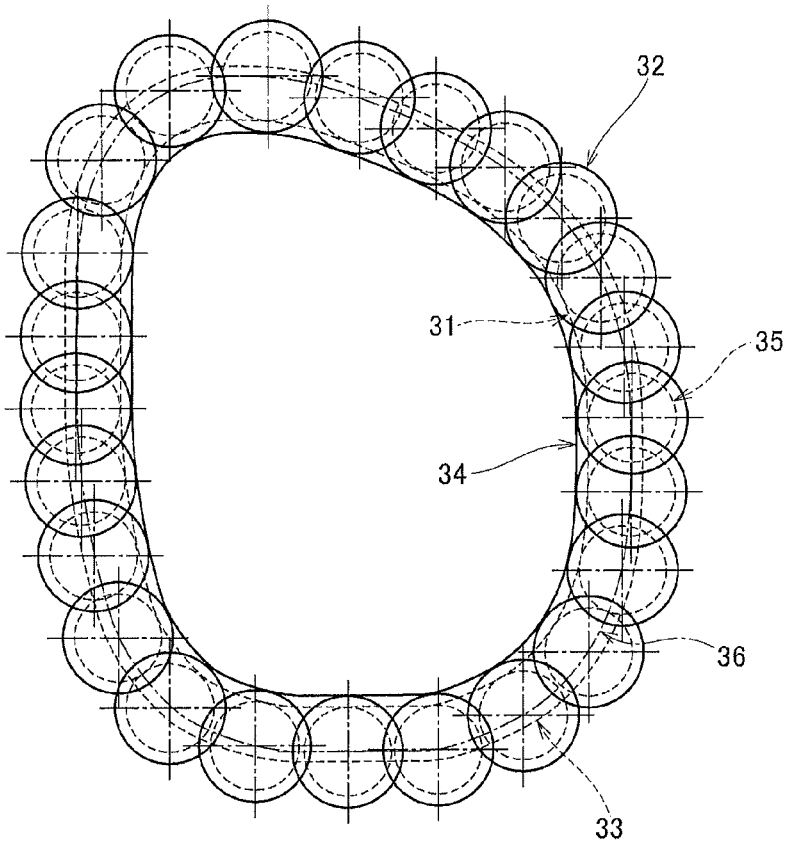
FIG. 8 is a view (No. 2) showing a relation between the tool diameter value used for calculating the edging locus data, and the circumferential length of the spectacle lens edged in accordance with the edging locus data.

FIG. 8 shows a case that the tool diameter is corrected so that the tool diameter value used for calculating the edging locus data becomes small, namely shows a case that the correction value takes a negative value. In this case, the edging locus data 36 is calculated using a smaller tool diameter value 35 than the defined tool diameter 32, for the edging shape data 31. The edging locus data 36 is set more inside than the edging locus data 33 calculated based on the define tool diameter 32. Therefore, a feeding amount of the edging tool to the spectacle lens is increased by a decrease of the tool diameter of the edging tool predicted by calculation. However, even if the tool diameter value used for calculation is corrected, the diameter of this edging tool is not changed. Therefore, the outer shape 37 of the spectacle lens when edged by the edging tool with the defined tool diameter 32, is formed more inside of the edging shape data 31. Accordingly, the outer size of the spectacle lens becomes small, compared with a case before the tool diameter value is corrected, and the circumferential length of the spectacle lens also becomes short.

Figure 9:
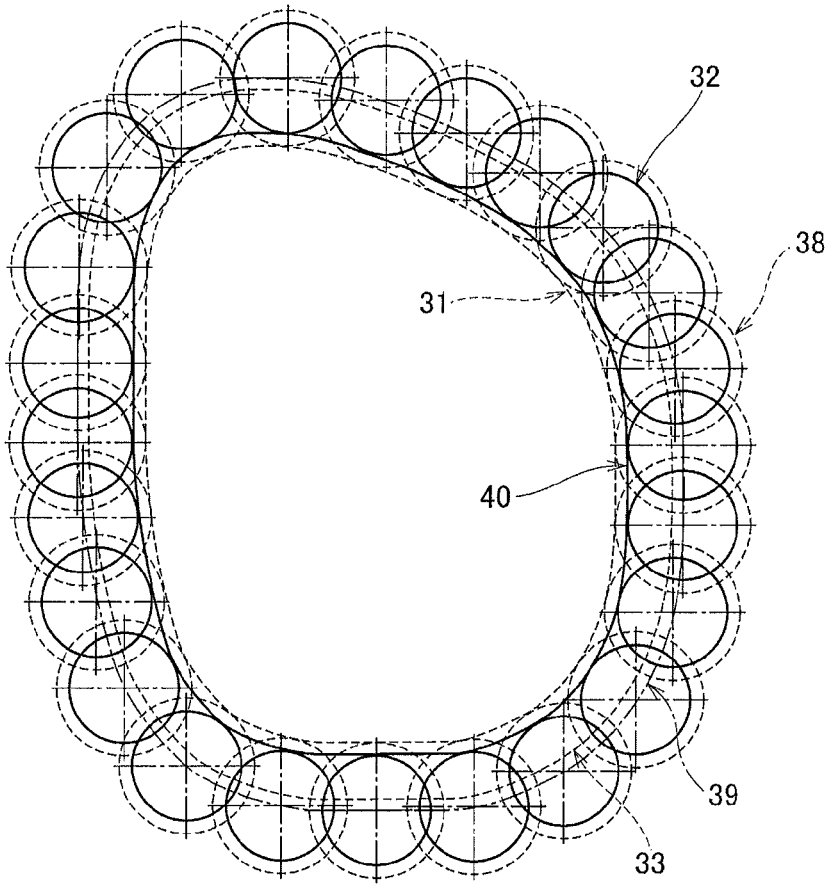
FIG. 9 is a view (No. 3) showing a relation between the tool diameter value used for calculating the edging locus data, and the circumferential length of the spectacle lens edged in accordance with the edging locus data.

FIG. 9 shows a case that the tool diameter used for calculating the edging locus data, is corrected so as to be large, namely shows a case that the correction value takes a positive value. In this case, the edging locus data 39 is calculated for the edging shape data 31, to calculate the edging locus data 39 using a larger tool diameter value 38 than the defined tool diameter 32. The edging locus data 39 is set more outside than the edging locus data 33 calculated based on the defined tool diameter 32. Therefore, the feeding amount of the edging tool to the spectacle lens is decreased by increase of the tool diameter of the edging tool predicted by calculation. However, even if the tool diameter value used for calculation is corrected, the tool diameter of this edging tool is not changed. Therefore, an outer shape 40 of the spectacle lens when edged by the defined tool diameter 32, is formed more outside than the edging shape data 31. Accordingly, the outer size of the spectacle lens is larger than the case before the tool diameter value is corrected, and the circumferential length of the spectacle lens also becomes long.

As described above, when the measured circumferential length is shorter than the theoretical circumferential length, the measured circumferential length can approach the theoretical circumferential length by edging thereafter, by correcting the tool diameter value by the correction value so that the tool diameter value after correction becomes large by a suitable amount. Also, when the measured circumferential length is larger than the theoretical circumferential length, the measured circumferential length can approach the theoretical circumferential length by edging thereafter, by correcting the tool diameter value by the correction value so that the tool diameter value after correction becomes small by a suitable amount.

Thereafter, after the spectacle lens is mounted on a lens axis of the edger 9 by the operator, instruction of start of edging is given by button operation, etc. Then, the edger 9 executes edging of the spectacle lens under this instruction (S30). In this case, in the edger 9, the abovementioned rough edging and finish edging are sequentially performed using the edging tool of the edger 9, by suitably drive-controlling each actuator. Then, when edging of the spectacle lens is finished, drive of the actuator is stopped in the edger 9. The rough edging and the finish edging may be performed using the same edging tool, or may be performed using a different edging tool. Thereafter, the operator takes out the edged spectacle lens from the lens axis of the edger 9, and returns it to an original tray.

Next, the tray in which the edged spectacle lens is contained, is transferred to an installation place of the three-dimensional circumferential length measurement device 10. There, the operator of the three-dimensional circumferential length measurement device 10 takes out the work sheet from the tray, and reads the barcode printed on the worksheet by the barcode reader attached to the three-dimensional measurement device 10 (S31). Next, the operator sets the spectacle lens in the three-dimensional circumferential length measurement device 10, so that the circumferential length of the spectacle lens is measured (S32).

More specifically, the operator of the three-dimensional circumferential length measurement device 10 sets the spectacle lens to be edged, in the three-dimensional circumferential length measurement device 10, and thereafter gives an instruction to start measurement by the button operation, etc. Then, in the three-dimensional circumferential length measurement device 10, drive of each actuator is started under this instruction. Thus, the stylus is brought into contact with a bevel portion of the edge surface of the spectacle lens, and in this state, the spectacle lens is rotated, to thereby displace the stylus in a diameter direction and a thickness direction of the spectacle lens. In the three-dimensional circumferential length measurement device 10, the displacement amount and the displacement direction of the stylus displaced as described above, is detected at each rotation angle of the spectacle lens, and based on this detection result, the circumferential length of the spectacle lens is three-dimensionally measured.

Thereafter, when measurement of the circumferential length by the three-dimensional circumferential length measurement device 10 is ended, the measured circumferential length obtained by this measurement, is transmitted to the server device 7 by the three-dimensional circumferential length measurement device 10, together with the job identification information acquired by reading the barcode (S33). Also, when the measurement of the circumferential length is ended, the operator takes out the edged spectacle lens from the lens holing part of the three-dimensional measurement device 10, and returns it to the original tray.

Next, the data management part 14 of the server device 7 receives the job identification information and the measured circumferential length transmitted from the three-dimensional circumferential length measurement device 10 as described above (S34). Next, the data management part 14 registers the measured circumferential length in the edging history table in the database part 15 in association with the received job identification information (S35). In this stage, information is registered in each column of the material of the spectacle lens, the type of the edging tool, the theoretical circumferential length, and the measured circumferential length in the edging history table (see FIG. 6), in association with the job identification information regarding this edging.

Next, the data management part 14 calculates the difference between the measured circumferential length and the theoretical circumferential length (called a "circumferential difference" hereafter) using the measured circumferential length and the theoretical circumferential length registered in the database part 15 as described above (S36). Next, the data management part 14 judges whether the circumferential difference obtained by calculation is set in a preset proper range, in terms of the quality of the spectacle lens as a final product (S37). Then, if the circumferential difference is set in the proper range, the client device 8 is notified (transmitted) accordingly (S38). This notification includes the job identification information regarding the job that normally ends the edging. When the circumferential difference is out of the proper range, it is highly likely that some abnormality has occurred, and therefore a series processing is ended by performing error processing not shown.

Here, calculation of the circumferential difference and judgment of success/non-success thereof are performed by the data management part 14. However, the present invention is not limited thereto, and these processing can be performed by the three-dimensional circumferential length measurement device 10.

Next, after the notification from the server device 7 is received (S39), the edging controller 16 of the client PC requests the server device 7 to provide the edging history data registered in the database part 15 in association with the job identification information included in this notification (S40).

Next, after the request from the server device 7 is received (S41), the data management part 14 of the server device 7 extracts the edging history data indicated by this request, from the database part 15 (S42).

The data management part 14 extracts at least one of the edging history data registered in the edging history table in the same combination as the combination of the material of the spectacle lens and the type of the edging tool used for this edging, from the edging history table of the edger 9 from which the edging history data is requested by the server device 7. How many edging history data is extracted, can be arbitrarily set. As a preferable example, a plurality of (for example ten) edging history data in the same combination as the combination of the material of the spectacle lens and the type of the edging tool used for this edging, are extracted in an order from a newly registration in the database part 15. As a specific example, if the material of the spectacle lens is "M1", and the type of the edging tool is "T3", which are used for this edging, a plurality of edging history data (shown by star mark in the figure) in the same combination as the combination of M1 and T3 are extracted. However, when an exchange work of the edging tool is performed, it is preferable to extract a plurality of edging history data in the same combination as the combination of the material of the spectacle lens and the type of the edging tool used for this edging.

Next, the data management part 14 transmits the plurality of edging history data extracted from the database part 15, to the client device 8 (S43). The edging history data transmitted at this time, includes at least the theoretical circumferential length and the measured circumferential length.

Next, the edging controller 16 of the client device 8 receives the plurality of edging history data transmitted from the server device 7 (S44). Next, the calculation part 18 of the client device 8 obtains an average value of the circumferential difference using the received plurality of edging history data (S45). Specifically, first, the difference between the measured circumferential length and the theoretical circumferential length, is obtained as the circumferential difference, for each edging history data. Further, by dividing the obtained circumferential difference by the number of the edging history data, the average value of the circumferential difference is obtained.

Next, the edging size monitor part 17 of the client device 8 judges whether the correction value of the correction table is required to be changed using the average value of the circumferential difference (S46). Necessity/non-necessity for changing the correction value, is performed by judging whether the average value of the circumferential difference obtained as described above, is set in a previously set defined range. Specifically, if the average value of the circumferential difference is set in a defined range, it is so judged that the correction value is not required to be changed, and the processing is ended here. Further, if the average value of the circumferential difference exceeds the defined range, it is so judged that the correction value is required to be changed, and the processing is advanced to the subsequent processing.

Next, the edging size monitor part 17 changes the correction value registered in the correction table in the same combination as the combination of the material of the spectacle lens and the type of the edging tool used for this edging, out of the correction values registered in the correction table shown in FIG. 5 (S47). The correction value is changed for reducing (ideally canceling) the difference between the measured circumferential length and the theoretical circumferential length. In this case, how much the correction value of the correction table should be changed, may be obtained by converting the average value of the circumferential difference to the radius based on the average value of the circumferential difference. However, increase of the correction frequency occurs by correcting the correction value only once to cancel the circumferential difference (to be zero), and there is a high risk of size failure due to excessively large correction amount in each correction. Therefore, the following correction is preferable: namely, a maximum correction amount that can be allowed in a single correction is set, and based on this correction amount, the correction value is changed in multiple number of times, so that the measured circumferential length is gradually approached to the theoretical circumferential length. For example, if the correction amount is 0.05 mm which is required for setting the circumferential difference to be zero, and the maximum correction amount is 0.02 mm which can be allowed in a single correction, the correction value is preferably changed in three times. In this case, the maximum correction amount that can be allowed in each single correction, is previously set for each lens material, and it is preferable to switch the maximum correction amount for each lens material.

Change of the correction value is performed as follows: for example, if the material of the spectacle lens used for this edging is "M1", and the type of the edging tool is "T3", the value of the correction value H23 is changed, which is registered in the correction table in the same combination as the combination of "M1" and "T3". Thus, when edging is performed thereafter, in the same combination as the combination of the material of the spectacle lens and the type of the edging tool used for this edging, the edging locus data is calculated using the tool diameter value corrected by the changed correction value as the calculation parameter. Further, in the edger 9, edging is performed to the spectacle lens in accordance with the edging locus data reflecting the tool diameter value corrected by the changed correction value.

Effect of the Embodiment

According to an embodiment of the present invention, the calculation parameter (tool diameter value of the edging tool) used for calculating the edging locus data, is corrected based on the difference between the measured circumferential length obtained by measurement by the three-dimensional circumferential length measurement device 10 and the theoretical circumferential length obtained by calculation. Thus, the circumferential length can be properly adjusted (corrected) without collapsing the outer shape of the spectacle lens. Further, improvement of further edging precision can be realized, compared with a case that the axis distance between the holding axis of the edging tool and the lens axis is adjusted as conventional. The reason will be described hereafter.

Figure 10:
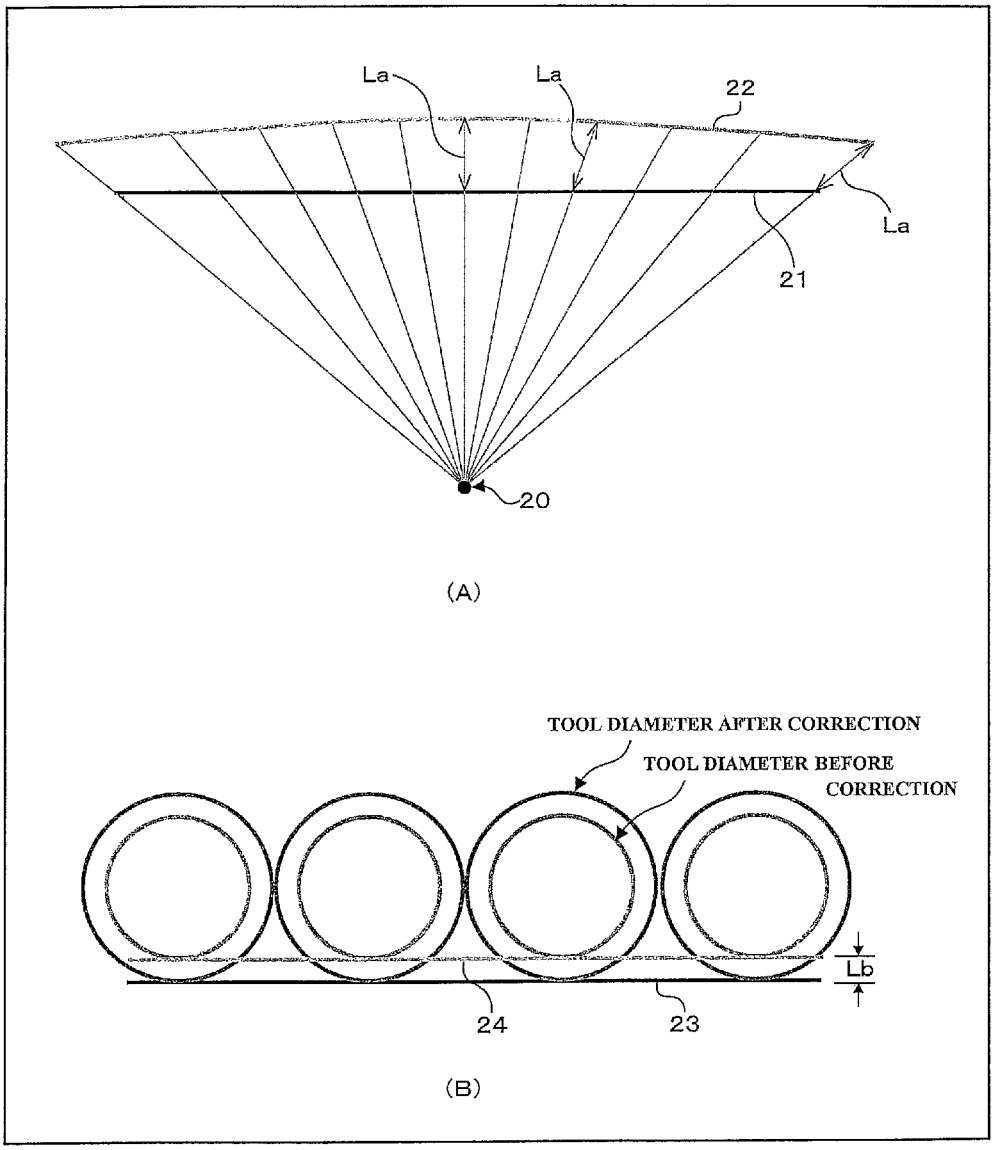
FIG. 10 is a view showing a difference of a correction principle of the edging size between a case of adjusting an axis distance and a case of correcting a calculation parameter.

First, the axis distance between the holding axis of the edging tool and the rotation axis of the lens holder, is adjusted not by physically deviating the position of each axis, but by changing the setting of the value of the axis distance by the operator using an operation panel, etc., of the edger 9. By thus adjusting the axis distance, for example as shown in FIG. 10(A), size correction is radially added by the same amount La from a rotation center 20 of the spectacle lens. Therefore, if an outline of the spectacle lens edged without adjusting the axis distance, is a straight line 21, the outline of the spectacle lens subjected to edging, with the axis distance adjusted, is a curved line 22 curved (bulged) to outside. Accordingly, if the size of the spectacle lens is corrected by adjusting the axis distance, the outer shape of the spectacle lens is collapsed. If the outer shape of the spectacle lens is actually collapsed, there is a problem that deviation occurs in a pupil distance for example when the spectacle lens is framed into the spectacle frame, even if the circumferential length of the spectacle lens is set in a desired dimension range.

On the other hand, for example as shown in FIG. 10(B), if the tool diameter value of the edging tool used for the calculation parameter of the edging locus data is corrected so as to be smaller after correction, compared with a case before correction, size correction is added to the outline of the spectacle lens by the same amount Lb in an orthogonal direction (normal direction). Therefore, if the outline of the spectacle lens is a straight line 23 before the tool diameter value is corrected, the outline of the spectacle lens is also a straight line 24 in parallel to the straight line 23 even after the tool diameter value is corrected. Accordingly, the size (circumferential length) of the spectacle lens can be corrected, without collapsing the outer shape of the spectacle lens.

Further, when the axis distance is adjusted, it is likely to change an edging interference before/after this adjustment. The edging interference is a phenomenon in which by contact (interference) of the edging tool with other portion of the spectacle lens, extra edging is added to this portion. In the edger 9, although the edging locus data is calculated in consideration of the edging interference, the edging interference which is not predicted by calculation can occur by adjusting the axis distance. Therefore, for example when a mountain-like bevel is formed on the edge surface of the spectacle lens, there is a problem that thinning of the bevel occurs at a part of the outer circumference of the lens.

On the other hand, when the tool diameter value of the edging tool is corrected, the edging interference is calculated in consideration of the tool diameter value after correction, and then the edging locus data is calculated. Therefore, almost no edging interference occurs, which is not predicted by calculation of the edging locus data. Accordingly, by performing edging to the spectacle lens in accordance with the edging locus data obtained by calculation, the edging error due to unpredicted edging interference can be reduced. Further, by calculating the edging locus data using the tool diameter value after correction, the edging error of the spectacle lens can be properly corrected, which is caused by deterioration of edging performance due to wear or clogging, etc., of the edging tool.

As a result, further high precision of the edging size of the spectacle lens can be realized, compared with a case of adjusting the axis distance.

Further, in this embodiment, the correction value is registered in the correction table in association with the material of the spectacle lens and the type of the edging tool, and using the correction value read from the correction table, the calculation parameter (tool diameter value of the edging tool) is corrected for each material of the spectacle lens and for each type of the edging tool. If the material of the spectacle lens is changed, difference is generated in the size of the spectacle lens after edging, even if the spectacle lens is edged by the same edging tool and in accordance with the same edging locus data. This is because the edging performance (such as scraping easiness of the lens) and an edging condition (such as rotation speed of the edging tool) are different, depending on the material of the spectacle lens (typically glass lens or plastic lens). Therefore, the size of the spectacle lens can be corrected with high precision, compared with a case that the size correction is performed simply in each unit of the edging tool irrespective of the material of the spectacle lens.

Further, in this embodiment, every time the edging is performed once to the spectacle lens, the edging history data at this time is stored in the database part 15, and a plurality of edging history data is selected therefrom and used in the same combination as the combination of the material of the spectacle lens and the type of the edging tool used for this edging, to thereby obtain the average value of the circumferential difference. Therefore, for example, the influence of error, etc., in measurement of the circumferential length can be reduced, and the necessity/non-necessity for changing the correction value can be precisely judged. Further, in this embodiment, when the average value obtained as described above exceeds a defined range, it is so judged that the correction value is required to be changed, thus changing the correction value registered in the correction table in the same combination as the combination of the material of the spectacle lens and the type of the edging tool used for this edging. Therefore, not only correction of the calculation parameter used for calculating the edging locus data, but also the correction value used for correcting the calculation parameter, can be properly changed in consideration of the combination of the material of the spectacle lens and the type of the edging tool.

Figure 11:
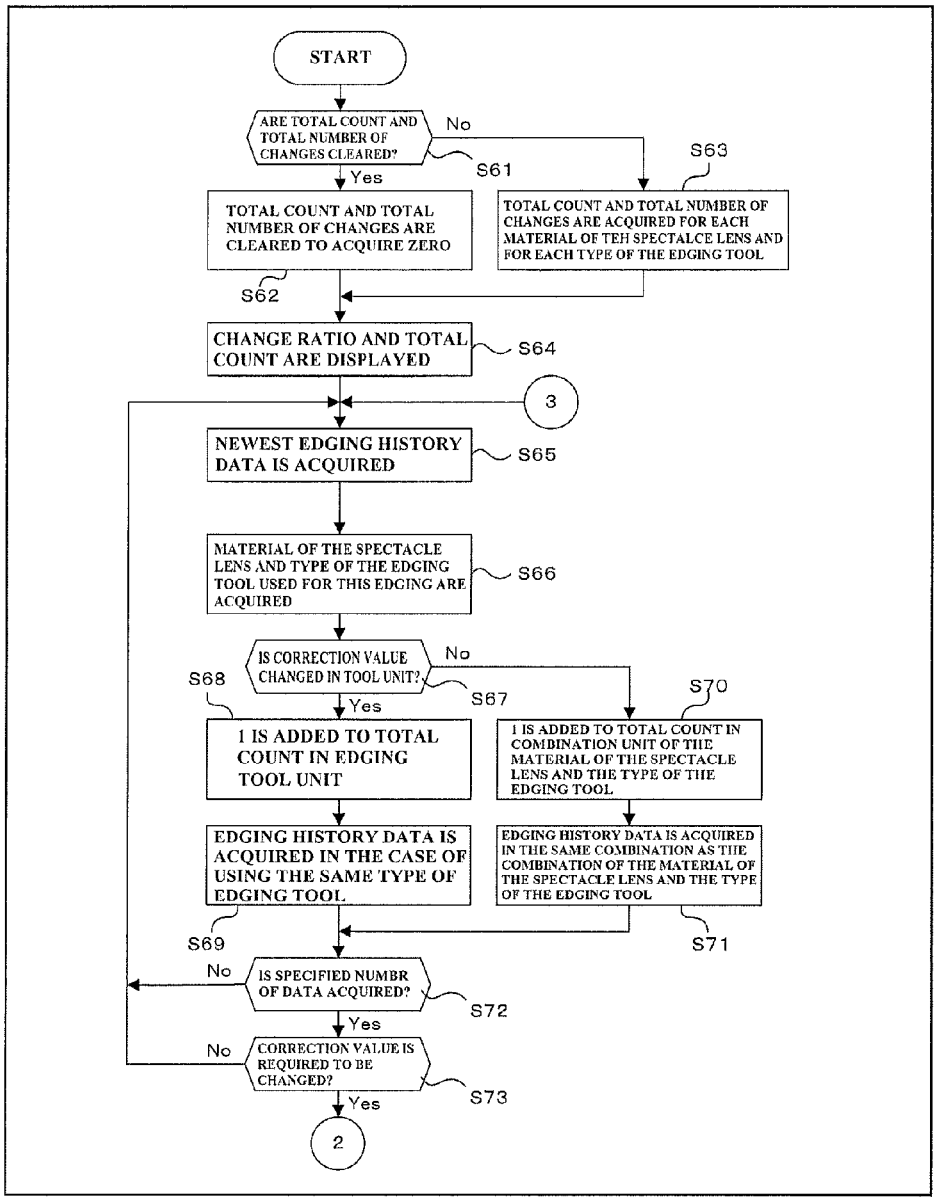
FIG. 11 is a flowchart (No. 1) showing an example of processing that can be executed using the lens edging system of this embodiment.
Figure 12:
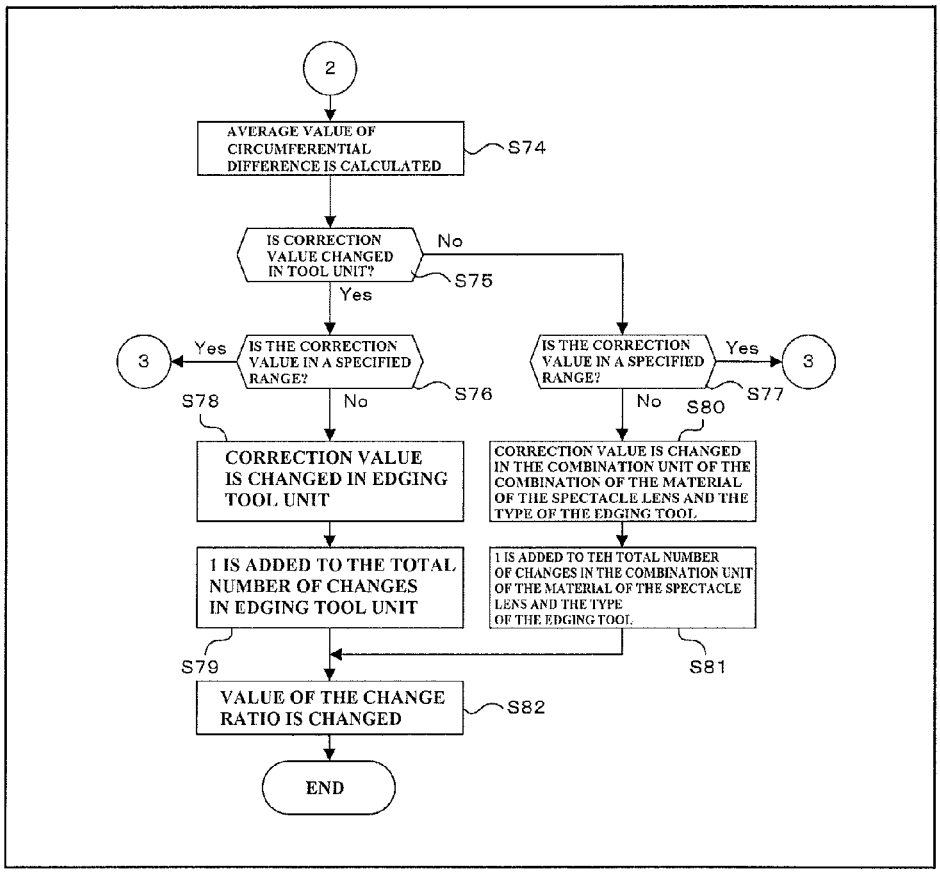
FIG. 12 is a flowchart (No. 2) showing an example of processing that can be executed using the lens edging system of this embodiment.

FIG. 11 and FIG. 12 are flowcharts showing an example of the processing that can be executed using the lens edging system according this embodiment. The processing shown in the figure is performed by the client device 8 for performing maintenance of each one of a plurality of edgers 9 connected to the client device 8. Here, as an example, explanation is given for a case that the edger 9 as unit 1 is selected as an object for the maintenance.

First, whether the total count and total number of changes should be cleared, is judged (S61). Specifically, when exchange of the edging tool is performed in the edger 9, the judgment is Yes, and otherwise, the judgment is No. The total count is the number of times of performing edging to the spectacle lens after exchange of the edging tool, regarding the edger 9 as unit 1. The total count is an index for exchanging the edging tool. The number of changes is the number of times of changing the correction value registered in the correction table, regarding the edger 9 as unit 1. These numbers of times are managed (counted) by the data management part 14 of the server device 7 using the database part 15.

Next, when the judgment is Yes in the step S61, the total count and the total number of changes are cleared, to set the value as zero (S62). Further, when the judgment is No in the step S61, the total count and the total number of changes are acquired, which are managed by the data management part 14 of the server device 7 for each material of the spectacle lens and for each type of the edging tool (S63).

Next, the change ratio and the total count are displayed on a screen of the monitor of the client device 8 (S64). The change ratio is an index for managing a state of the edger 9, and is obtained based on the following formula (2).

$$\text{Change ratio (\%)} = \text{total number of changes} \div \text{total count} \times 100 \quad (2)$$

Next, regarding the edger 9 as unit 1, newest edging history data is acquired from the edging history table registered in the database part 15 (S65).

Next, the material of the spectacle lens and the type of the edging tool used for this edging is acquired by referencing the order reception data registered in the database part 15 (S66).

Next, whether the change of the correction value used for correcting the calculation parameter is performed in the tool unit (for each type) of the edging tool, is judged (S67). The unit for changing the correction value includes a combination unit of the material of the spectacle lens and the type of the edging tool, other than the tool unit. Which unit is used for changing the correction value, is previously set in each edger 9. Therefore, in step S67, the unit for changing the correction value is judged in accordance with a pre-set.

Regarding the type of the edging tool used for this edging, when the judgment is Yes in the step S67, 1 is added to the total count of all lens materials, irrespective of the difference of the material of the spectacle lens (S68). Next, the specified number of the edging history data registered in the edging history table when edging is performed in the past, is acquired using the same type of edging tool as the type of the edging tool used for this edging (S69). Namely, after 1 is added to the total count in the unit of the edging tool, the edging history data in the case of using the same type of the edging tool, is acquired.

On the other hand, when the judgment is No in the step S67, 1 is added to the total count, in the combination of the material of the spectacle lens and the type of the edging tool used for this edging (S70). Next, the specified number of edging history data registered in the edging history table when edging is performed in the past, is acquired in the same combination as the combination of the material of the spectacle lens and the type of the edging tool used for this edging (S71). Namely, after 1 is added to the total count in the combination unit of the material of the spectacle lens and the type of the edging tool, the edging history data is acquired in the same combination as the above combination.

Next, in the steps S69 and S71, whether the specified number of edging history data can be acquired, is judged (S72). When the judgment is No in this step S72, the processing is returned to the step S65, to obtain the judgment of Yes in this stage, and then the processing is advanced to the next step S73.

In step S73, whether the correction value should be changed, is judged regarding the material of the spectacle lens and the type of the edging tool used for this edging. When the judgment is No in the step S73, the processing is returned to the step S65, to obtain the judgment of Yes in this stage, and then the processing is advanced to the next step S74.

In step S74, the average value of the circumferential difference between the measured circumferential length and the theoretical circumferential length is obtained by calculation, using the specified number of edging history data.

Next, similarly to the step S67, whether the correction value is changed in the tool unit, is judged (S75). When the judgment is Yes in this step S75, the processing is advanced to step S76, and when the judgment is No, the processing is advanced to step S77.

In step S76, whether the average value of the circumferential difference obtained in the step S74 is in a specified range, is judged. The specified range can be suitably changed.

Next, when the judgment is Yes in the step S76, the processing is returned to step S65, and when the judgment is No in step S76, the correction value registered in the correction table corresponding to the type of the edging tool used for this edging, is changed by suitable amount for all lens materials, regardless of the difference of the material of the spectacle lens (S78). Next, 1 is added to the total number of changes of all lens materials irrespective of the difference of the material of the spectacle lens, regarding the type of the edging tool used for this edging, (S79). Namely, 1 is added to the total number of changes after the correction value is corrected in the edging tool unit.

On the other hand, in step S77, whether the average value of the circumferential difference obtained in the step S74 is in the specified range, is judged. The specified range can be suitably changed.

Next, when the judgment is Yes in the step S77, the processing is returned to step S65. Also, when the judgment is No in step S77, the correction value registered in the correction table corresponding to the material of the spectacle lens and the type of the edging tool used for this edging, is changed by a suitable amount (S80). Next, 1 is added to the total number of changes, regarding the material of the spectacle lens and the type of the edging tool used for this edging (S81).

Namely, after the correction value is changed in the unit of the combination of the material of the spectacle lens and the type of the edging tool, 1 is added to the total number of changes.

Thereafter, in step S82, the change ratio is calculated again based on the formula (2), and based on the calculation result, the value of the change ratio displayed on the screen is changed.

By performing such a processing, in the edging center 2, the state of the edger 9 can be grasped, and a maintenance time for tool exchange, etc., can be predicted by viewing the information (the change ratio and the total count) displayed on the monitor screen of the client device 8 by the operator, etc.

DESCRIPTION OF SIGNS AND NUMERALS

1 Spectacle shop
2 Edging center
3 Communication line
4 Lens edging system
5 Ordering terminal
6 Tracer
7 Server device
8 Client device
9 Edger
10 Three-dimensional circumferential length measurement device

The invention claimed is:

1. A lens edging system, comprising:

a lens holder configured to secure a lens and rotate the lens about a lens axis;

an edger configured to perform edging to the lens with an edging tool for edging;

the edging tool for edging configured to rotate about a tool axis offset from the lens axis, at least one of the lens holder and the edger being configured to allow a distance between the tool axis and the lens axis to be adjustable;

a three-dimensional measurement device configured to three-dimensionally measure an actual circumferential edge length of the lens;

a controller configured to:

receive edging shape data defining a desired finish shape of the lens with a theoretical circumferential edge length, the controller configured to use the edging shape data and a calculation tool diameter of an edging tool for calculation to calculate three-dimensional edging locus data defining distances between the tool axis and the lens axis wherein the edging tool, at the calculation tool diameter, maintains tangential contact with the desired finish shape defining a plurality of points of contact around the entire theoretical circumferential edge length;

perform a first edging operation by rotating the lens about the lens axis, rotating the edging tool for edging about the tool axis and controlling the distance between the tool axis and the lens axis using the three-dimensional edging locus data, receive a three-dimensional measurement of an actual circumferential edge length of the lens after the first edging operation, calculate a difference between the actual circumferential edge length and the theoretical circumferential edge length, determine a correction value based on the difference, calculate a corrected tool diameter of the edging tool for calculation based on applying the correction value to the calculation tool diameter, use the edging shape data to calculate corrected three-dimensional edging locus data defining corrected distances between the tool axis and the lens axis wherein the distance between the tool axis and the lens axis is adjusted based on maintaining a cutting edge of the edging tool, at the corrected tool diameter, coincident with the respective plurality of points of tangential contact around the entire theoretical circumferential edge length, and perform another edging operation by rotating a second lens about the lens axis, rotating the edging tool about the tool axis and controlling the distance between the tool axis and the lens axis using the corrected three-dimensional edging locus data to produce a finish shape of the second lens with a corrected circumferential edge length.

2. The lens edging system according to claim 1, further comprising a memory that stores and holds a plurality of predetermined correction values in association with (i) different spectacle lens materials and (ii) different edging tool types, wherein the controller corrects the calculation tool diameter value of the edging tool for each spectacle lens material and for each edging tool type, using the stored and held predetermined correction values.

3. The lens edging system according to claim 2, wherein the memory is further configured to sequentially store the measured value of the circumferential length and the theoretical value of the circumferential length as edging history data, in association with a spectacle lens material of the spectacle lens and an edging tool type of the edging tool used, every time the edging is performed once;

and wherein the controller is further configured to:

extract from the memory a plurality of edging history data stored in the memory, each of the extracted plurality of edging history data being associated with the same spectacle lens material and edging tool type as that of a current edging; and obtain an average value of the difference between the measured circumferential length and the theoretical circumferential length using the extracted plurality of edging history data, and when the obtained average value exceeds a preset defined range, change the correction value used for the current edging.

4. The lens edging system according to claim 1, further comprising:

a memory configured to sequentially store the measured value of the circumferential length and the theoretical value of the circumferential length as edging history data, in association with a spectacle lens material of the spectacle lens and an edging tool type of the edging tool used, every time the edging is performed once;

wherein the controller is further configured to:

extract from the memory a plurality of edging history data stored in the memory, each of the extracted plurality of edging history data being associated with the same spectacle lens material and edging tool type as that of a current edging; and obtain an average value of the difference between the measured circumferential length and the theoretical circumferential length using the extracted plurality of edging history data, and when the obtained average value exceeds a preset defined range, change the correction value used for the current edging.

5. A controller that controls a lens edging system that includes (i) a lens holder configured to secure a lens and rotate the lens about a lens axis; (ii) an edger configured to perform edging to the lens with an edging tool for edging; the edging tool for edging configured to rotate about a tool axis offset from the lens axis, at least one of the lens holder and the edger being configured to allow a distance between the tool axis and the lens axis to be adjustable; and (iii) a three-dimensional measurement device configured to three-dimensionally measure an actual circumferential edge length of the lens; the controller being configured to:

receive edging shape data defining a desired finish shape of the lens with a theoretical circumferential edge length, and use the edging shape data and a calculation tool diameter of an edging tool for calculation to calculate three-dimensional edging locus data defining distances between the tool axis and the lens axis wherein the edging tool, at the calculation tool diameter, maintains tangential contact with the desired finish shape defining a plurality of points of contact around the entire theoretical circumferential edge length;

perform a first edging operation by rotating the lens about the lens axis, rotating the edging tool for edging about the tool axis and controlling the distance between the tool axis and the lens axis using the three-dimensional edging locus data, receive a three-dimensional measurement of an actual circumferential edge length of the lens after the first edging operation, calculate a difference between the actual circumferential edge length and the theoretical circumferential edge length, determine a correction value based on the difference, calculate a corrected tool diameter of the edging tool for calculation based on applying the correction value to the calculation tool diameter, use the edging shape data to calculate corrected three-dimensional edging locus data defining corrected distances between the tool axis and the lens axis wherein the distance between the tool axis and the lens axis is adjusted based on maintaining a cutting edge of the edging tool, at the corrected tool diameter, coincident with the respective plurality of points of tangential contact around the entire theoretical circumferential edge length, and perform another edging operation by rotating a second lens about the lens axis, rotating the edging tool about the tool axis and controlling the distance between the tool axis and the lens axis using the corrected three-dimensional edging locus data to produce a finish shape of the second lens with a corrected circumferential edge length.

6. A method of controlling a lens edging system that includes (i) a lens holder configured to secure a lens and rotate the lens about a lens axis; (ii) an edger configured to perform edging to the lens with an edging tool for edging; the edging tool for edging configured to rotate about a tool axis offset from the lens axis, at least one of the lens holder and the edger being configured to allow a distance between the tool axis and the lens axis to be adjustable; and (iii) a three-dimensional measurement device configured to three-dimensionally measure an actual circumferential edge length of the lens; the method comprising:

receiving edging shape data defining a desired finish shape of the lens with a theoretical circumferential edge length, and using the edging shape data and a calculation tool diameter of an edging tool for calculation to calculate three-dimensional edging locus data defining distances between the tool axis and the lens axis wherein the edging tool, at the calculation tool diameter, maintains tangential contact with the desired finish shape defining a plurality of points of contact around the entire theoretical circumferential edge length;

performing a first edging operation by rotating the lens about the lens axis, rotating the edging tool for edging about the tool axis and controlling the distance between the tool axis and the lens axis using the three-dimensional edging locus data, receiving a three-dimensional measurement of an actual circumferential edge length of the lens after the first edging operation, calculating a difference between the actual circumferential edge length and the theoretical circumferential edge length, determining a correction value based on the difference, calculating a corrected tool diameter of the edging tool for calculation based on applying the correction value to the calculation tool diameter, using the edging shape data to calculate corrected three-dimensional edging locus data defining corrected distances between the tool axis and the lens axis wherein the distance between the tool axis and the lens axis is adjusted based on maintaining a cutting edge of the edging tool, at the corrected tool diameter, coincident with the respective plurality of points of tangential contact around the entire theoretical circumferential edge length, and performing another edging operation by rotating a second lens about the lens axis, rotating the edging tool about the tool axis and controlling the distance between the tool axis and the lens axis using the corrected three-dimensional edging locus data to produce a finish shape of the second lens with a corrected circumferential edge length.

* * * * *